US010759574B1

(12) United States Patent
Li

(10) Patent No.: US 10,759,574 B1
(45) Date of Patent: Sep. 1, 2020

(54) CUP LID

(71) Applicant: Hsin-Chieh Li, Changhua (TW)

(72) Inventor: Hsin-Chieh Li, Changhua (TW)

( * ) Notice: Subject to any disclaimer, the term of this patent is extended or adjusted under 35 U.S.C. 154(b) by 0 days.

(21) Appl. No.: 16/352,617

(22) Filed: Mar. 13, 2019

(30) Foreign Application Priority Data

Oct. 5, 2018 (TW) ..... 107213551 U

(51) Int. Cl.
*B65D 47/08* (2006.01)
*B65D 43/02* (2006.01)
*A47G 19/22* (2006.01)

(52) U.S. Cl.
CPC ..... *B65D 47/08* (2013.01); *A47G 19/2211* (2013.01); *B65D 43/0218* (2013.01); *B65D 2231/022* (2013.01); *B65D 2543/00046* (2013.01); *B65D 2543/00351* (2013.01)

(58) Field of Classification Search
CPC ..... B65D 2543/00046; B65D 2543/00351; B65D 47/08; B65D 47/0823; B65D 47/2018; B65D 47/0804
USPC ..... 220/714
See application file for complete search history.

(56) References Cited

U.S. PATENT DOCUMENTS 6,419,105 B1 * 7/2002 Bruce ..... B65D 47/06 220/266
6,612,456 B1 * 9/2003 Hundley ..... B65D 43/0212 220/254.1
D493,718 S * 8/2004 Durdon ..... D9/435
7,959,028 B2 * 6/2011 Leon ..... B65D 43/0204 220/213
9,027,784 B2 * 5/2015 Knipe ..... B65D 43/0212 220/713
9,034,231 B2 * 5/2015 Tabor ..... B26F 1/40 264/154
9,730,540 B2 * 8/2017 Tabor ..... B26F 1/40
9,814,334 B2 * 11/2017 Eickhoff ..... B65D 47/0833
10,264,902 B2 * 4/2019 Althaher ..... B65D 43/0214
2008/0000921 A1 * 1/2008 Leon ..... B65D 43/0204 220/713
2008/0061069 A1 * 3/2008 Edelstein ..... B65D 43/0212 220/713
2012/0097690 A1 * 4/2012 Chien ..... B65D 43/0212 220/713
2012/0261417 A1 * 10/2012 Tabor ..... B26F 1/40 220/254.1

(Continued)

FOREIGN PATENT DOCUMENTS

WO WO-2011024012 A1 * 3/2011 ..... B65D 21/0219
WO WO-2015170302 A3 * 10/2016 ..... B65D 51/1611

*Primary Examiner* — Allan D Stevens

(57) ABSTRACT

A cup lid may comprise a main body having a cup edge at an outer periphery thereof. An upper surface of the main body has a cover comprising a concave upper surface, and a first end and a second end are respectively formed at two opposed edges of the concave upper surface at corresponding positions. A concave sip portion formed adjacent to the first end, and a plane surface is formed at a bottom portion of the sip portion. A flippable sealing member extends from the plane surface, and a sip-through opening is formed overlapped with the sealing member. A month-contact portion is formed adjacent to the first end, and a height difference formed between the month-contact portion and the sip-through opening is configured to prevent the overflow of beverage when drinking.

7 Claims, 8 Drawing Sheets

(56) References Cited

U.S. PATENT DOCUMENTS

| | | | | |
|---|---|---|---|---|
| 2014/0048552 | A1* | 2/2014 | Wang | D21J 3/00 220/780 |
| 2015/0021345 | A1* | 1/2015 | Wu | B65D 47/0847 220/715 |
| 2015/0076151 | A1* | 3/2015 | Knipe | B65D 43/0212 220/254.3 |
| 2015/0201777 | A1* | 7/2015 | Kim | A47G 19/2272 220/713 |

* cited by examiner

CUP LID

FIELD OF THE INVENTION

The present invention relates to a cup lid and more particularly to a cup lid that can provide more drinking ways for a user.

BACKGROUND OF THE INVENTION

A hot drink such as coffee and tea is usually served in a paper cup due to high temperature and covered with a lid made of heat-resistant plastic material to prevent spilling and easily be carried by a user. A cup lid generally has a sip portion that can be opened to enable a user to have drink without taking out the lid.

However, the conventional cup lid has following disadvantages: (i) it is difficult to insert a straw through an opening of the sip portion, which limits the cup lid to be only used for hot drinks; and (ii) when a user drinking, a plane inner surface of the cup lid makes the beverage inside the cup easy to be spilled out, which may soil user's clothes. Therefore, there remains a need for a new and improved design for a cup lid to overcome the problems presented above.

SUMMARY OF THE INVENTION

The present invention provides a cup lid which comprises a main body having a cup edge at an outer periphery thereof. A middle portion of the cup edge comprises an annular first engaging portion which is an inward recess to form a ring portion thereabove on the cup edge. An upper surface of the main body has a cover protruding upwardly, and an outer diameter of the cover is gradually smaller from bottom to top to form an inclined surface as an outer wall of the cover. The cover has a concave upper surface, and a first end and a second end are respectively formed at two opposed edges of the concave upper surface at corresponding positions, and a curve of the concave upper surface is formed from the first end to the second end to form into a concave portion at the upper surface of the cover. The first end is located higher than the second end. A concave sip portion is formed adjacent to the first end, and a plane surface is formed at a bottom portion of the sip portion which is located lower than the concave portion, and a flippable sealing member extends from the plane surface. A sip-through opening is formed overlapped with the sealing member such that the sealing member is configured to be flipped to unblock or block the sip-through opening. The sip portion comprises a month-contact portion which is located adjacent to the first end and formed perpendicular to the plane surface, and a height difference formed between the month-contact portion and the sip-through opening is configured to prevent the overflow of beverage when drinking.

In one embodiment, a third end and a fourth end are respectively formed at the other two opposed edges of the concave upper surface of the cover at corresponding positions which are respectively located at two lateral sides of the connection of the first end and the second end, and the third end and the fourth end are located at same height which are higher than the concave portion and lower than the second end.

In another embodiment, a lower end of the cover is located lower than the ring portion of the cup edge, and an annular locating portion is formed between the outer periphery of the cover and the cup edge.

In still another embodiment, the concave sip portion has a gourd-shaped cross section.

In a further embodiment, the sealing member has an engaging column formed adjacent to the first end, and a through hole penetrating through a center of the cover is adapted to engage with the engaging column when the sealing member is flipped up to unblock the sip-through opening.

In still a further embodiment, a flippable close piece extending from an edge of the through hole is adapted to be flipped to unblock or block the through hole.

In a particular embodiment, a lower portion of the cup edge is formed into a guiding portion which has a larger outer diameter.

Comparing with conventional cup lid, the present invention is advantageous because: (i) the main body provides a user with two different drinking ways, which greatly improves the practicability of the cup lid; and (ii) when the outflow of beverage happens during a user drinking, the spilled beverage is accumulated at the concave portion of the main body, and a user can tilt the drink cup to allow the spilled beverage to flow back toward the sip portion, thereby avoiding spilling of beverage.

DETAILED DESCRIPTION OF THE INVENTION

Figure 1:
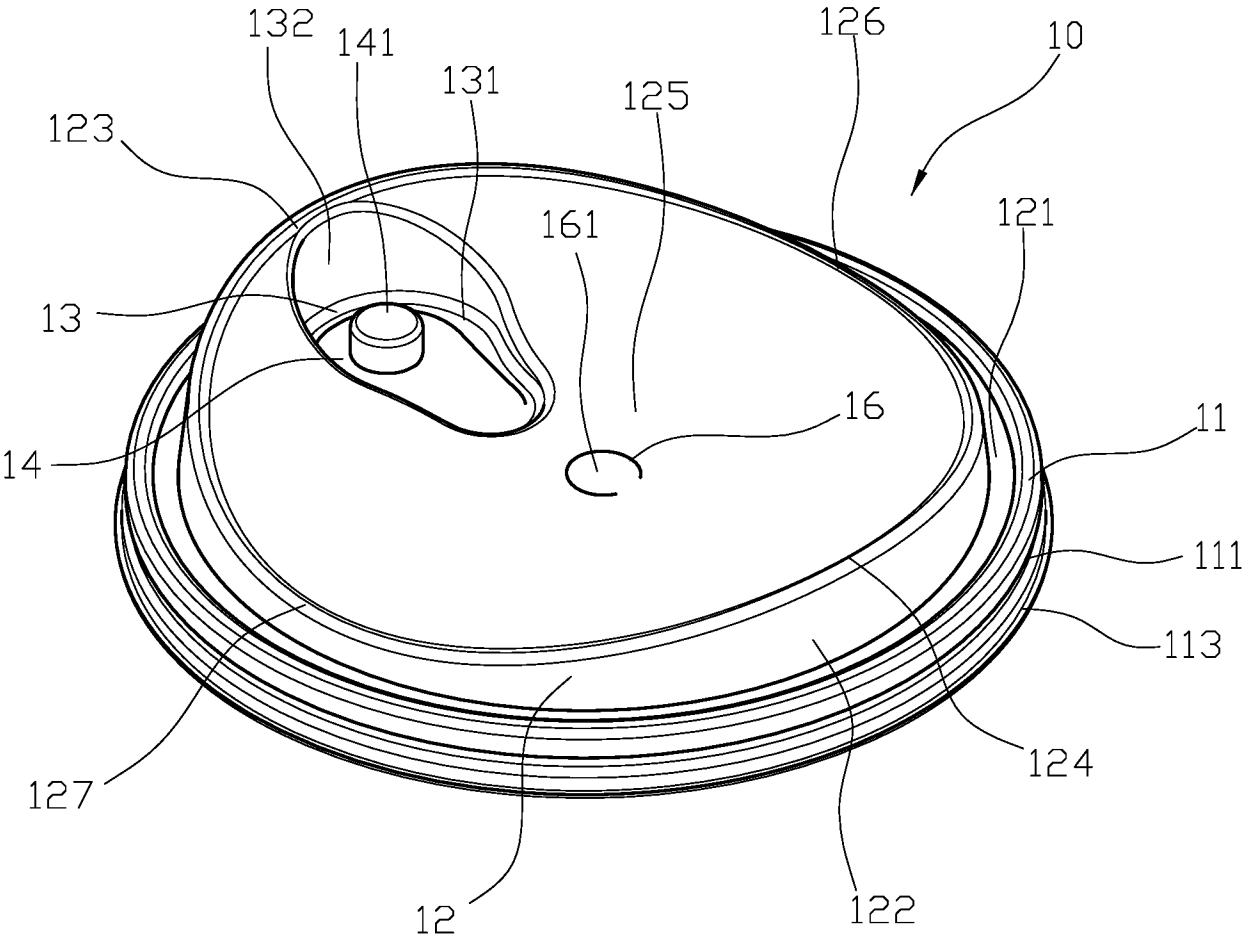
FIG. 1 is a three-dimensional view of a cup lid of the present invention.
Figure 2:
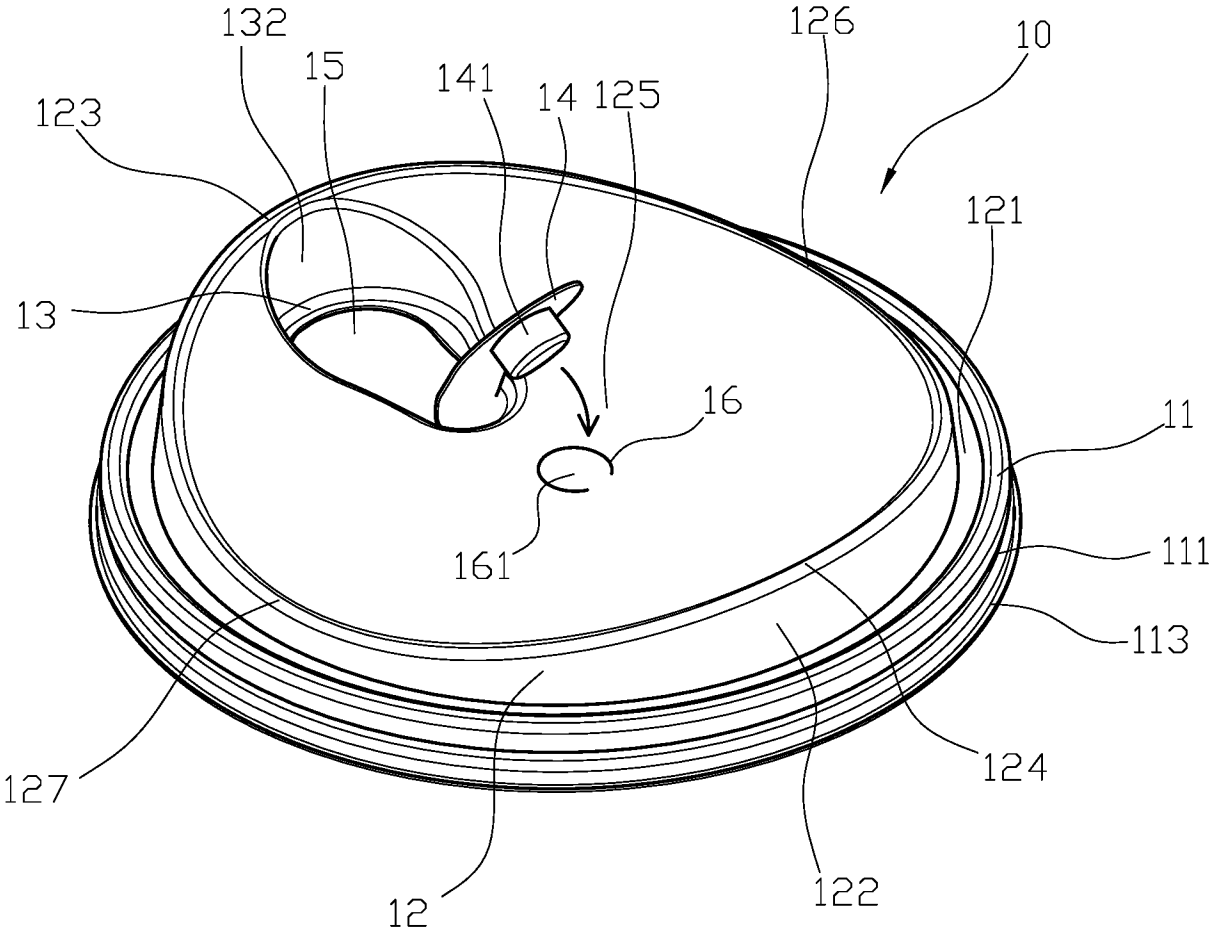
FIG. 2 is a three-dimensional view of the cup lid of the present invention when a sealing member is flipped up.
Figure 3:
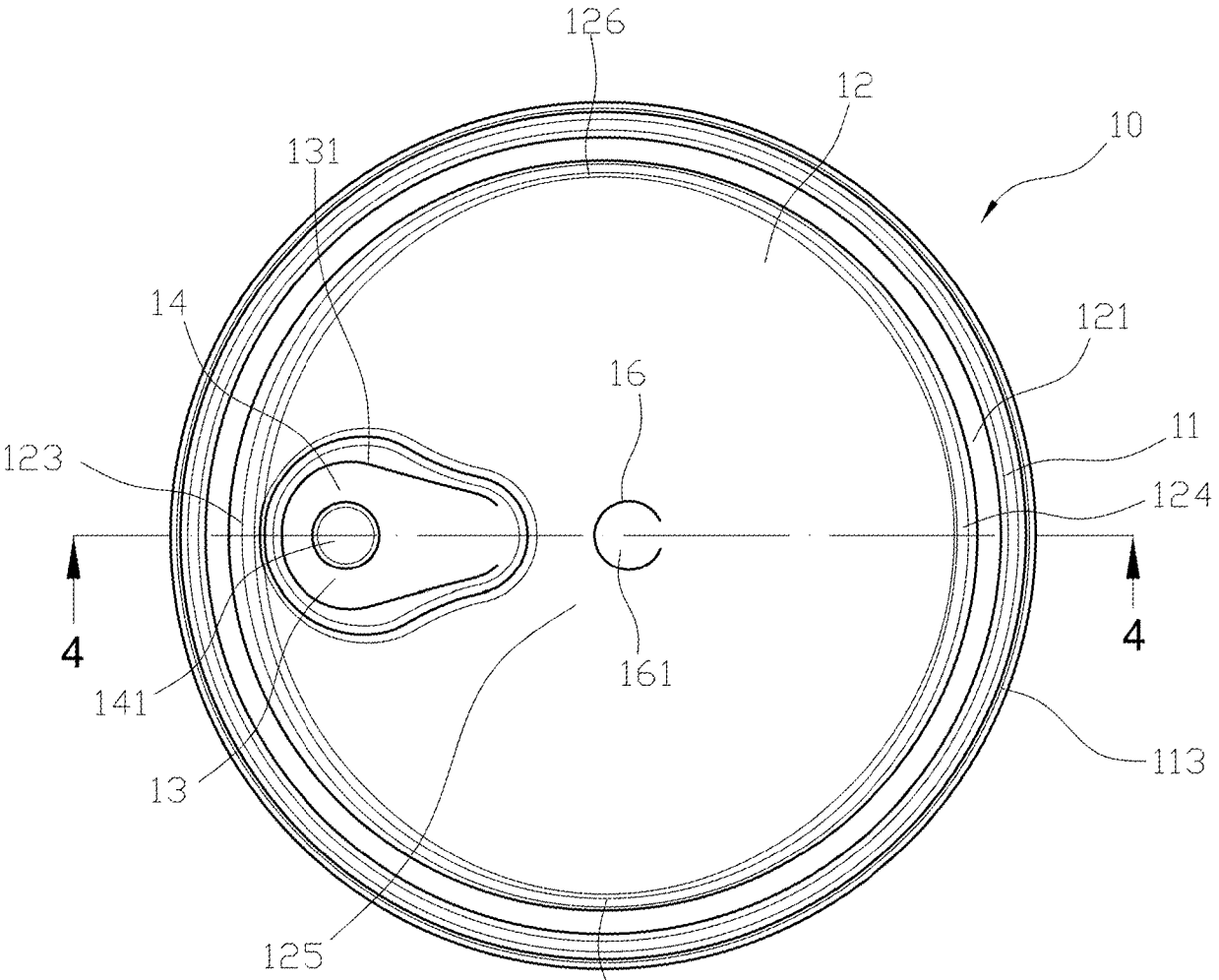
FIG. 3 is a top view of the cup lid of the present invention.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristics and effect of the present invention, a number of embodiments along with the drawings are illustrated as following:

Referring to FIGS. 1 to 4, the present invention provides a cup lid which comprises a main body (10) having a cup edge (11) at an outer periphery thereof. A middle portion of the cup edge (11) comprises an annular first engaging portion (111) which is an inward recess to form a ring portion (112) thereabove on the cup edge (11). Moreover, a lower portion of the cup edge (11) is formed into a guiding portion (113) which has a larger outer diameter. An upper surface of the main body (10) has a cover (12) protruding upwardly, and a lower end of the cover (12) is located lower than the ring portion (112) of the cup edge (11). Moreover, an annular locating portion (121) is formed between an outer periphery of the cover (12) and the cup edge (11), and the outer diameter of the cover (12) is gradually smaller from bottom to top to form an inclined surface (122) as an outer wall of the cover (12). Furthermore, the cover (12) has a concave upper surface, and a first end (123), a second end (124), a third end (126), and a fourth end (127) are respectively formed at four sides of the concave upper surface, wherein the first end (123) and the second end (124) are formed at two opposed edges of the cover (12) at corresponding positions while the third end (126) and the fourth end (127) are formed at the other two opposed edges of the cover (12) at corresponding positions, and a curve of the concave upper surface is formed from the first end (123) to the second end (124) to form into a concave portion (125) at the upper surface of the cover (12). Also, the first end (123) is located higher than the second end (124), and the third end (126) and the fourth end (127) are located at same height which is higher than the concave portion (125) and lower than the second end (124). Additionally, a concave sip portion (13) having a gourd-shaped cross section is formed adjacent to the first end (123), and a plane surface (131) is formed at a bottom portion of the sip portion (13) which is located lower than the concave portion (125), and a flippable sealing member (14) is extended from the plane surface (131). A sip-through opening (15) is formed overlapped with the sealing member (14) such that the sealing member (14) is configured to be flipped to unblock or block the sip-through opening (15). The sip portion (13) comprises a month-contact portion (132) which is located adjacent to the first end (123) and formed perpendicular to the plane surface (131), and a height difference formed between the month-contact portion (132) and the sip-through opening (15) is configured to prevent the overflow of beverage when drinking. Moreover, the sealing member (14) has an engaging column (141) formed adjacent to the first end (123), and a through hole (16) penetrating through a center of the cover (12) is adapted to engage with the engaging column (141) when the sealing member (14) is flipped up. In one embodiment, a flippable close piece (161) extending from an edge of the through hole (16) is adapted to be flipped to unblock or block the through hole (16).

Figure 4:
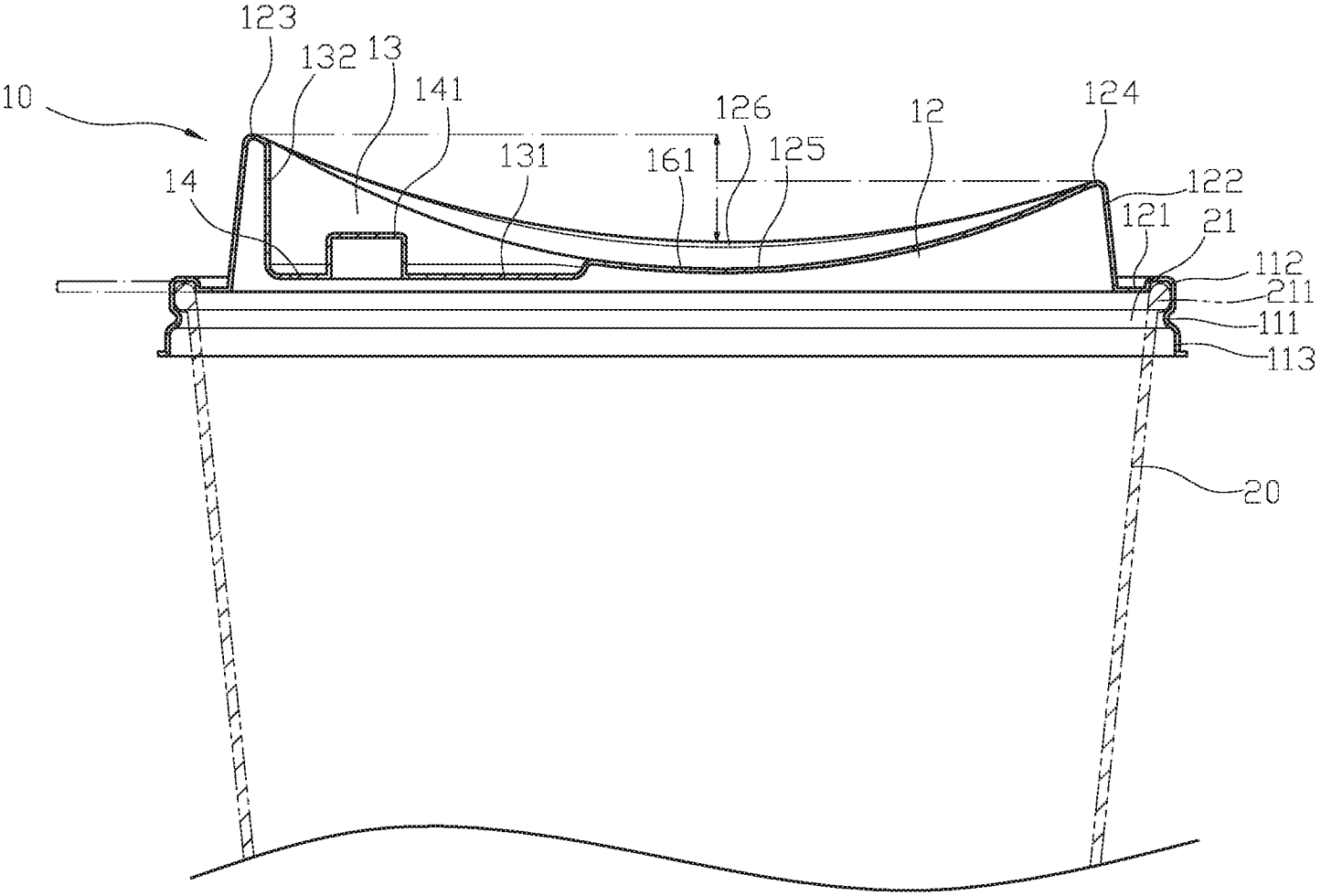
FIG. 4 is a sectional view taken along line 4-4 of FIG. 3 illustrating the cup lid of the present invention when covered on a drink cup.
Figure 5:
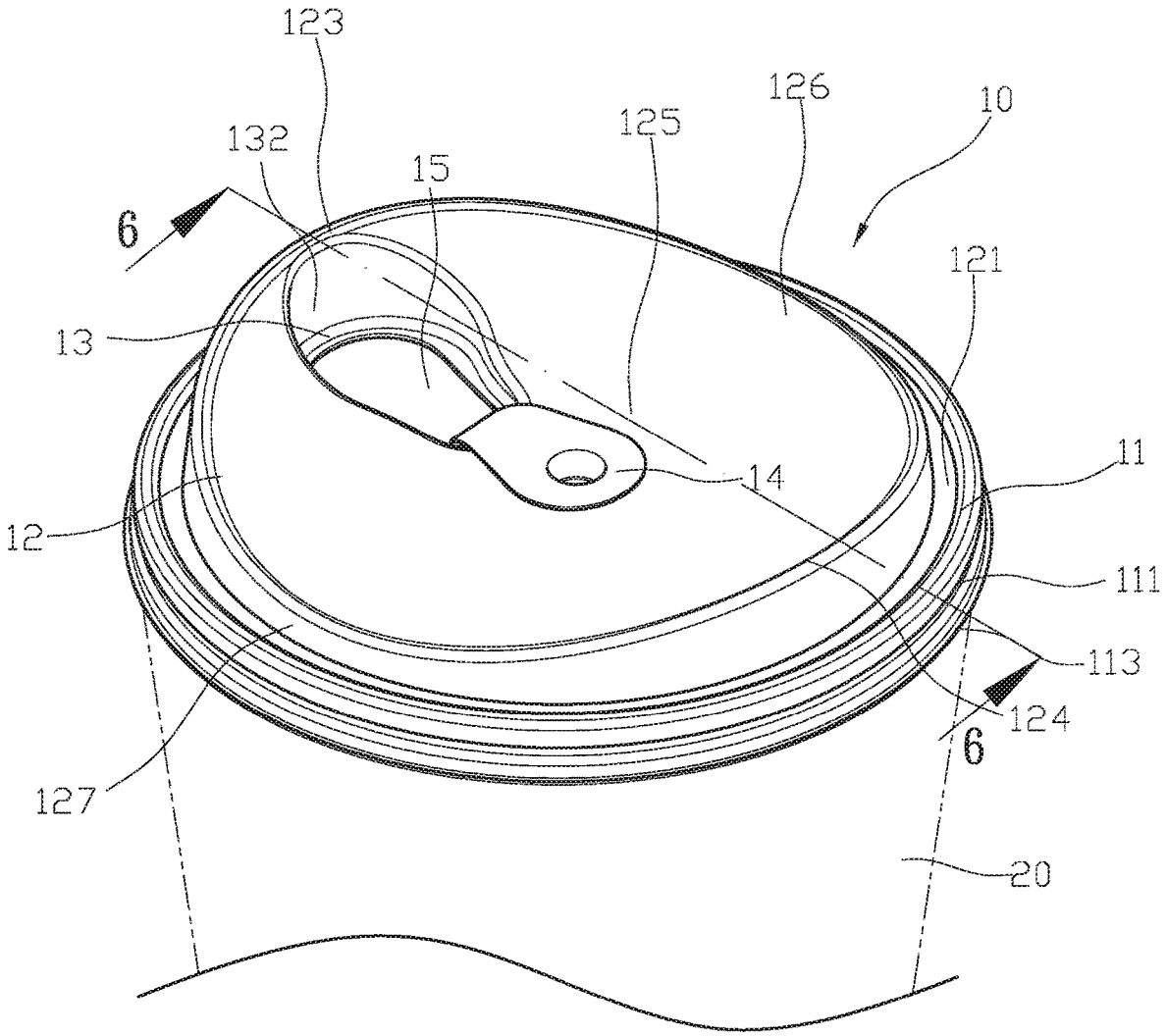
FIG. 5 is a schematic view illustrating the sealing member of the cup lid is flipped up and positioned in the present invention.
Figure 6:
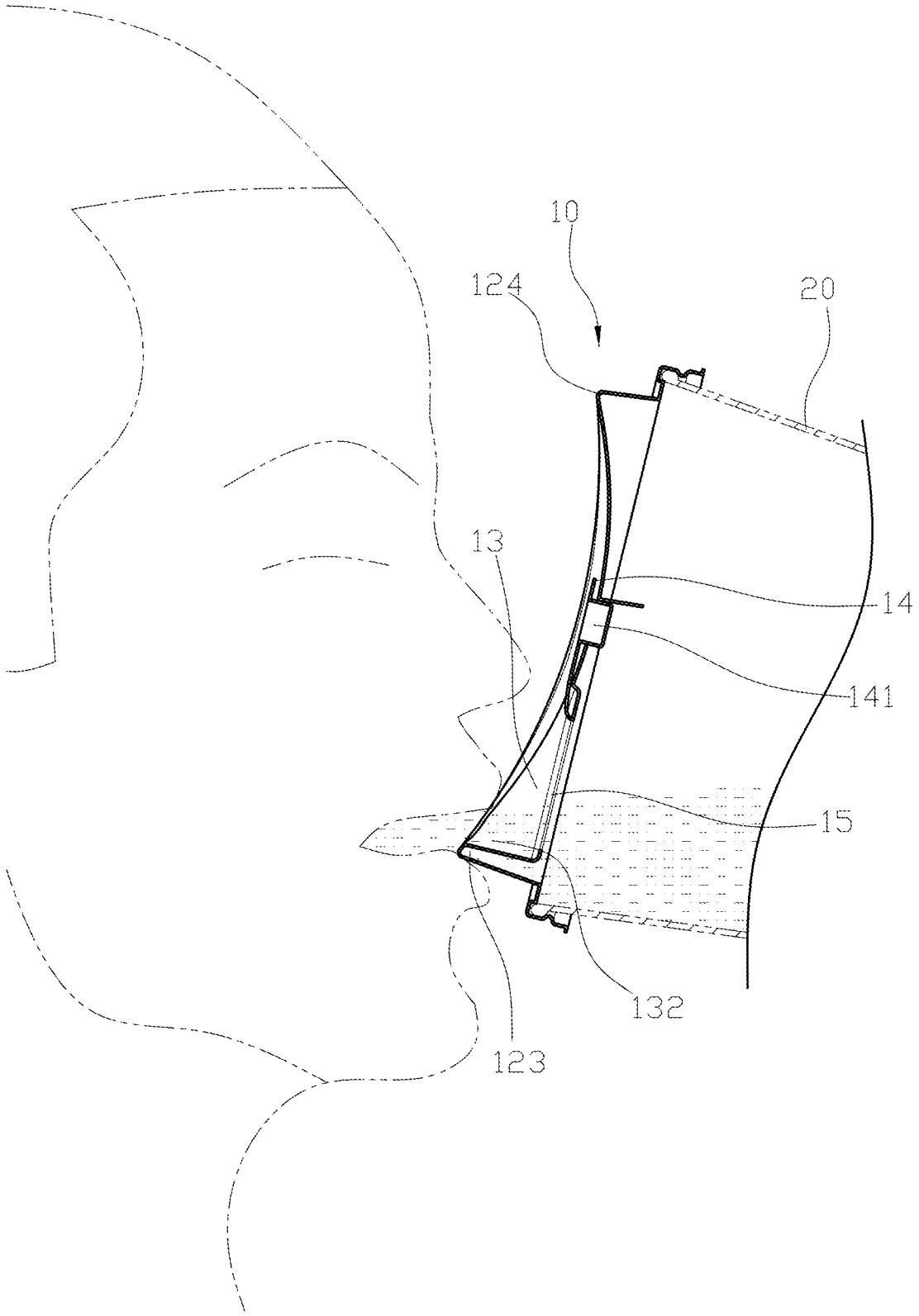
FIG. 6 is a sectional view taken along line 6-6 of FIG. 5 illustrating a user hold the drink cup to have beverage through the cup lid of the present invention.
Figure 7:
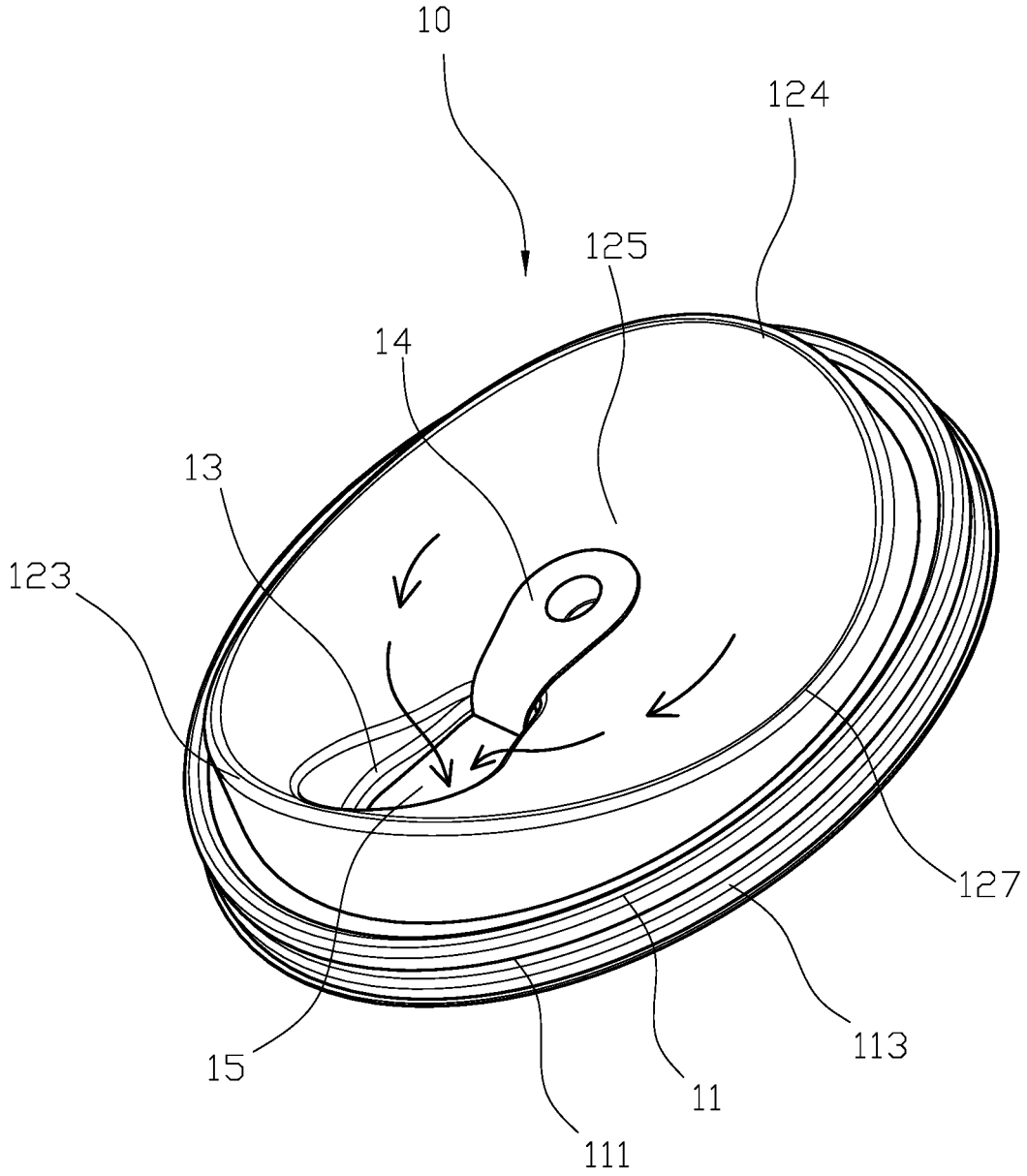
FIG. 7 is a schematic view illustrating the overflow of beverage flows back toward a sip portion of the cup lid of the present invention.

In actual application, referring to FIG. 4, the main body (10) is covered on an upper opening (21) of a drink cup (20), and the guiding portion (113) of the cup edge (11) is disposed and coupled on the upper opening (21) of the drink cup (20); when the main body (10) is disposed on the drink cup (20), a second engaging portion (211) formed at an outer periphery of the upper opening (21) is adapted to pass through the first engaging portion (111) and to squeeze in the ring portion (112), thereby securing the main body (10) on the drink cup (20).

Referring to FIGS. 2, 5, 6 and 7, when using, the sealing member (14) is flipped upward, and the engaging column (141) is adapted to be inserted and secured in the through hole (16) of the cover (12). As a result, the sip-through opening (15) is opened to allow a user to have the beverage contained in the drink cup (20) through the mouth-contact portion (132). Moreover, with the height difference between the mouth-contact portion (132) and the sip-through opening (15), when the drink cup (20) is put down on the table by the user, the beverage in the drink cup (20) is configured to flow along the mouth-contact portion (132) back in the drink cup (20) through the sip-through opening (15). Furthermore, the outer periphery of the cover (12) is higher than the concave portion (125) such that even the outflow of beverage happens, the spilled beverage is configured to be accumulated at the concave portion (125) instead of spilling out of the main body (10). Also, a user can tilt the drink cup (20) with the main body (10) to allow the spilled beverage to flow back toward the sip portion (13), thereby avoiding spilling of beverage.

Figure 8:
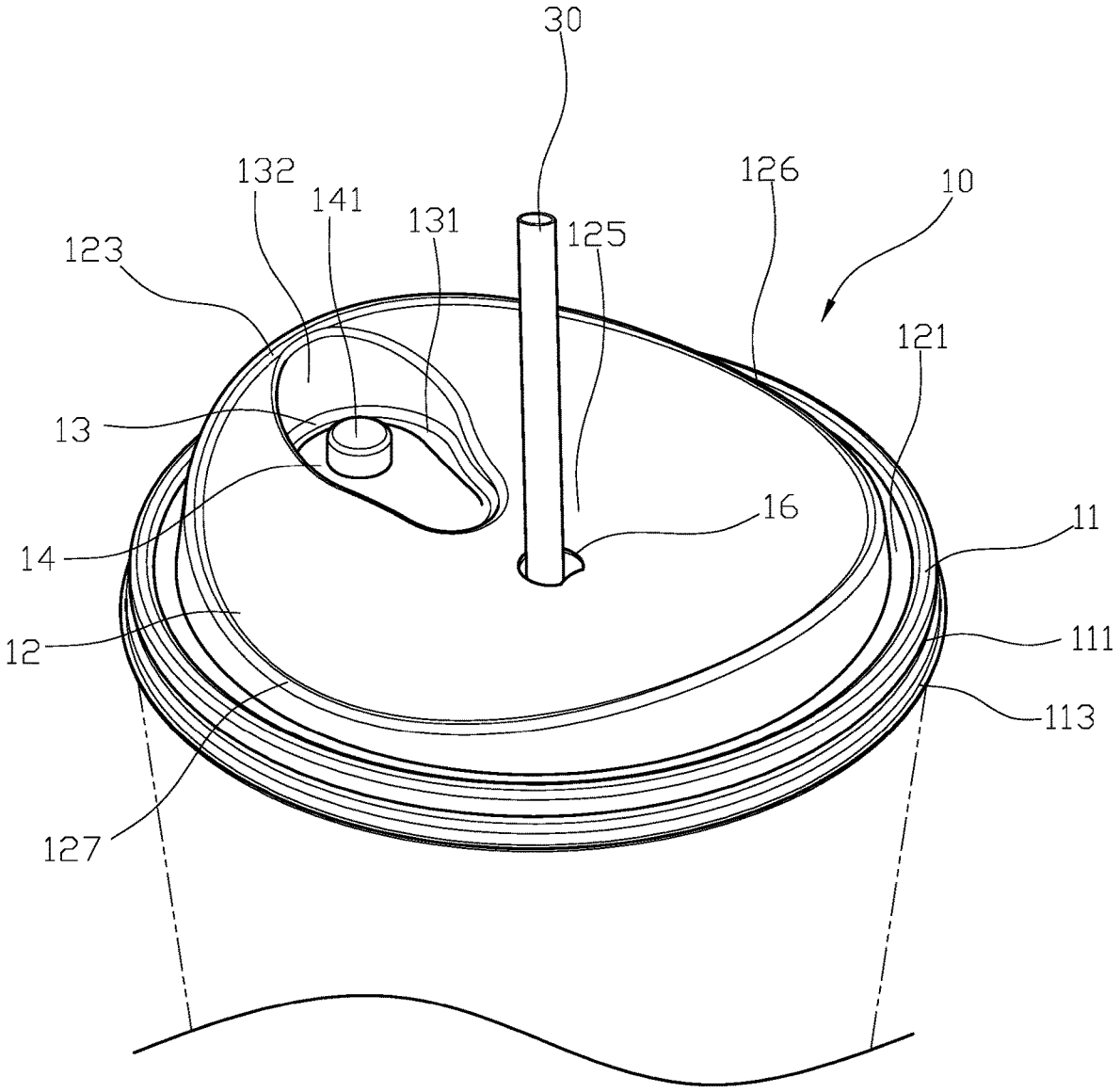
FIG. 8 is a schematic view illustrating a user have beverage in the drink cup through a straw.

Additionally, the main body (10) is adapted to be cooperatively used with a straw (30) directly. Referring to FIG. 8, the through hole (16) located at the center of the cover (12) is adapted to be penetrated through by the straw (30) so as to allow a user to have beverage in the drink cup (20) without opening the sip-through opening (15), which increases the practicability of the cup lid.

Comparing with conventional cup lid, the present invention is advantageous because: (i) the main body (10) provides a user with two different drinking ways, which greatly improves the practicability of the cup lid; and (ii) when the outflow of beverage happens during a user drinking, the spilled beverage is accumulated at the concave portion (125) of the main body, and a user can tilt the drink cup (20) to allow the spilled beverage to flow back toward the sip portion (13), thereby avoiding spilling of beverage.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A cup lid comprising:

a main body having a cup edge at an outer periphery thereof, and a middle portion of the cup edge comprising an annular first engaging portion which is an inward recess, a ring portion defined above the annular first engaging portion on the cup edge;

an upper surface of the main body having a cover protruding upwardly, and an outer diameter of the cover being gradually smaller from bottom to top to form an inclined surface as an outer wall of the cover;

the cover having a concave upper surface, and a first end and a second end respectively formed at two opposed edges of the concave upper surface at corresponding positions, and a curve of the concave upper surface formed from the first end to the second end to form a concave portion at the concave upper surface of the cover, and the first end located higher than the second end;

a concave sip portion formed adjacent to the first end, and a plane surface formed at a bottom portion of the concave sip portion and is located lower than the concave portion, and a flippable sealing member extended from the plane surface;

a sip-through opening overlapped by the sealing member such that the sealing member is configured to be flipped to unblock or block the sip-through opening;

the concave sip portion comprising a mouth-contact portion which is located adjacent to the first end and formed perpendicular to the plane surface, and a height difference, which is formed between the mouth-contact portion and the sip-through opening, configured to prevent overflow of beverage when drinking.

2. The cup lid of claim 1, wherein a third end and a fourth end are respectively formed at two other opposed edges of the concave upper surface of the cover at corresponding positions which are respectively located at two lateral sides of a connection of the first end and the second end, and the third end and the fourth end are located at a same height that is lower than the second end.

3. The cup lid of claim 1, wherein a lower end of the cover is located lower than an upper edge of the ring portion of the cup edge, and an annular locating portion is formed between an outer periphery of the cover and the cup edge.

4. The cup lid of claim 1, wherein the concave sip portion has a curvilinear cross section.

5. The cup lid of claim 1, wherein the sealing member has an engaging column formed adjacent to the first end, and a through hole penetrating through a center of the cover is adapted to engage with the engaging column when the sealing member is flipped up to unblock the sip-through opening.

6. The cup lid of claim 5, wherein a flippable close piece extending from an edge of the through hole is adapted to be flipped to unblock or block the through hole.

7. The cup lid of claim 1, wherein a lower portion of the cup edge is formed into a guiding portion which has an outer diameter greater than an outer diameter of the ring portion.

* * * * *